United States Patent [19]

Gray

[11] 4,357,063

[45] Nov. 2, 1982

[54] WASHER ANCHORING CONSTRUCTION

[76] Inventor: William T. Gray, 19612 Grandview Dr., Topanga, Calif. 90290

[21] Appl. No.: 157,140

[22] Filed: Jun. 6, 1980

[51] Int. Cl.[3] ..... H01R 13/639

[52] U.S. Cl. ..... 339/75 P; 339/107; 24/132 AA

[58] Field of Search ..... 24/115 G, 132 AA, 132 R, 24/211 M; 339/104, 75 P, 103 R, 107

[56] References Cited

U.S. PATENT DOCUMENTS

| | | | |
|---|---|---|---|
| 127,780 | 6/1872 | Marsh | 24/211 M |
| 1,452,150 | 4/1923 | Foster | 24/211 M |
| 2,089,665 | 8/1937 | Roberts et al. | 339/104X |
| 3,951,504 | 4/1976 | Clark | 339/104 X |
| 3,960,432 | 6/1976 | Wilbur | 339/75 P X |

*Primary Examiner*—Eugene F. Desmond

*Attorney, Agent, or Firm*—William W. Glenny

[57] ABSTRACT

A construction for protecting against damage to or unplugging of an electrical cord or plug connected to a portable musical instrument supported on the performer's shoulder by means of a strap attached to studs or the like projecting from the instrument body. The construction includes a washer removably mounted on one of such studs, serving not only to prevent accidental dislodgement of the strap from the stud, but also as an anchoring point for the electrical cord. The assembly between the cord and washer may include an elongated resilient member to snub or soften any jerk on the cord resulting for example from sudden or excessive movement of the performer. The washer includes two circular members each having a pear-shaped opening, the washer being in locked position when the openings are out of registration with one another.

2 Claims, 5 Drawing Figures

20
22
12
14
24
34
33
31
26
52
50
53
54
55
56
58
60
62
42
40
44
-10-
IV
27
30
25
28
16
10
144
162

WASHER ANCHORING CONSTRUCTION

BACKGROUND AND SUMMARY OF THE INVENTION

This invention relates generally to an anchoring washer adapted for use with a portable and movable musical instrument having a plug and electrical cord attached thereto, and particularly describes a construction for preventing tension from being imposed on the plug and adjacent electrical cord during a performer's movements while playing the instrument.

The musical instruments to which the present invention is especially applicable are string instruments such as guitars which have electromagnetic means for amplifying the sound created by the strings. Typically such an instrument has an electrical cord removably plugged into its body and it is a common observation that the performer's physical movements during play can impose damaging stress on the plug and cord connection and not infrequently pull the cord plug out from its socket. Such a guitar is provided with studs or similar projections, usually with enlarged heads, to which ends of a supporting strap may be attached, the strap usually extending over the performer's shoulder and across his back to support most of the weight of the instrument. The present invention provides an anchoring construction for the electrical cord by using one of the strap studs, together with a washer of novel design and operation and interconnecting tension members, including a resilient member, between the washer and the cord.

It is therefore the principal object of the present invention to provide a novel washer anchoring construction for a portable electrical musical instrument or the like. Additional objects are to provide, in such a construction, a removable washer for attachment to a stud typically provided on such an instrument; to provide a tension absorbing construction for the electrical cord typically used with such instruments; and for other objects as will become clear from a reading of the following description of an illustrative form of the invention taken in connection with the accompanying drawing.

DETAILED DESCRIPTION

Figures 1, 2, 3, 4, 5:
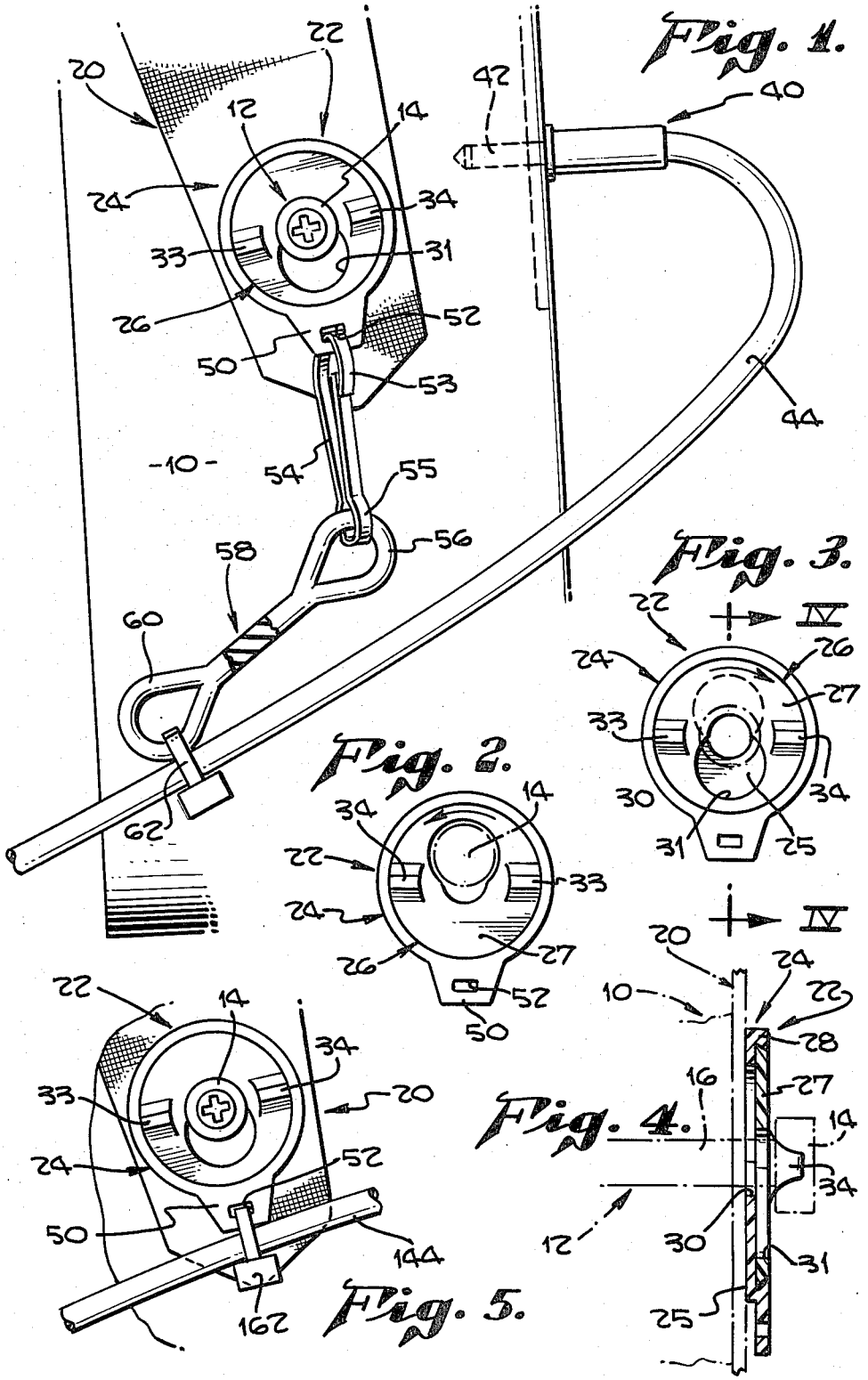
FIG. 1 is a fragmentary side elevational view of a portion of the body of an electric guitar illustrating the invention.
FIG. 2 is a view of the washer in its open position, the enlarged head of a stud being shown in dotted outline.
FIG. 3 is a view similar to FIG. 2 showing the washer in its closed or locked position.
FIG. 4 is a sectional view taken on arrows IV—IV of FIG. 3, including in dotted outline fragments of the guitar body, strap and stud.
FIG. 5 is a view of a modified form of the invention not embodying a resilient tension member.

In FIG. 1 a portion of a body of an electric guitar is indicated generally at 10 having fixed thereto and extending therefrom a stud indicated generally at 12. The stud has an enlarged head 14 (see FIG. 4) with a larger diameter than that of the stud shank 16 which extends into and is fixed to the guitar body as, for example, by being threaded therein. The lower portion of a flexible supporting strap is indicated generally at 20 and is attached to the shank 16 as by a slit or opening formed in the strap material, such attachment being conventional in the art.

Outwardly of strap 20 on stud shank 16 and serving to retain the strap on the shank is an enlarged washer of the present invention indicated generally at 22 and including a generally circular female member or receiver 24 and, rotatably housed therein, a locking plate 26. Receiver 24 has a flat central web 25 which, as best seen in FIG. 4, is bounded by a circular peripheral lip 28. Locking plate 26 also has a flat central web 27 having a flanged outer edge which is received in a continuous perpheral recess formed in the lip 28. The outer edge of the plate and the inner face of the lip recess are complementarily frusto-conical in contour, so that the locking plate is retained against axial movement relative to the receiver, but is permitted rotational movement. The material of which the two parts are made is desirably a slightly deformable plastic substance to permit initial assembly of the locking plate into the receiver, and the dimensions are such as to provide a small but significant amount of friction between the parts so that the locking plate will remain in whatever angular position relative to the receiver that it may be moved by the user, to be later described.

Each of the webs 25 and 27 is provided with an irregularly shaped opening 30 and 31 respectively, here illustratively shown as pear-shaped. The openings are so disposed and shaped relative to the common axis of the circular webs that rotation of the locking plate relative to the receiver will, selectively, cause the two web openings either to coincide in registration with one another, or to be out of registration. The former or unlocked position, seen in FIG. 2, creates a large effective opening, sized to allow the enlarged stud head 14 to pass through, while the latter or locked position, seen in FIG. 2, provides a small effective opening, sized to be substantially smaller than the stud head diameter. Preferably the minimum dimension of the small opening is approximately the diameter of the stud shank 16.

Locking plate 26 may be provided with one or preferably two finger grips 33, 34 projecting from web 27 to facilitate the user's rotation of the plate between its position of FIGS. 2 and 3.

With further reference to FIG. 1, an electrical plug indicated generally at 40 is plugged into a jack 42 in the guitar body 10, and is attached to cord 44 carrying electrical signals from the instrument to suitable amplifying equipment well known in the art. Means are provided in accordance with the invention for anchoring cord 44, and through it, plug 40, in such a way as to prevent tension or other force from being applied to the plug or the immediately adjacent part of the cord despite movement of the user.

Thus receiver 24 of washer 20 is provided with a preferably integrally formed projecting tab 50 having a small opening 52 formed therein through which a portion 53 of a detachable hook 54 extends. The other end 55 of hook 54 passes through an eye 56 at one end of a resilient connector tension member 58 desirably made of rubber or equivalent material. Connector member 58 has another eye 60 at its other end, which is permanently attached by a suitable fitting 62 to cord 44 at a point spaced sufficiently from plug 40 to make certain that the portion of the cord between fitting 62 and plug 40 remains loose and free from tension at all times.

Accordingly the construction just described accomplishes the object of the invention in preventing damage to the plug and cord, and at the same time provides flexibility in use in that, for example, the detachable hook 54 may be easily removed from the washer tab 50, and the plug 40 can be removed from its jack 42, thereby permitting the user to move about freely while the guitar itself remains in playing position on the user's body, supported by strap 10.

An alternative form of the invention is shown in FIG. 5, in which a fitting 162, fixedly attached to cord 144, is attached directly to tab 50 through opening 52. As will be seen, the form of FIG. 5 is more compact than the form earlier described, but does not include the feature of detachability independent of the washer 22, or the snubbing action provided by the resilient connector member 58.

What is claimed is:

1. In a washer anchoring construction for a strap supported portable musical instrument or the like having an elongated cord connected to the instrument body and attachment stud means carried by the body for detachable attachment to a supporting strap, the provision of:

a washer selectively attachable to the stud means;

and means attaching the washer to the cord at such a point along its length that the portion of the cord between said point and the point of connection of the cord to the body is not under tension, said washer including:

a receiver having a flat generally circular web having formed therein an eccentric opening;

a locking plate having a flat generally circular web having formed therein an eccentric opening;

means retaining said webs in adjacent relation and rotatable relative to one another whereby to place said openings, selectively, in registration and out of registration with one another, said locking plate being provided with means for facilitating rotation of the plate by the user comprising a pair of finger grips projecting from the plate and disposed symmetrically about the rotational axis.

2. An anchoring washer for selective application to and removal from a stud including a shank having a first outside diameter and an enlarged head having a second outside diameter larger than the first outside diameter comprising:

a receiver having a flat generally circular web bounded by an enlarged peripheral rim extending circumferentially about the axis of the web and having formed therein an inturned lip defining a continuous annular recess, the web having formed therein an eccentric opening;

and a locking plate housed in the receiver and having a continuous circular flanged outer edge rotatably received in the receiver recess for restraining the locking plate against axial movement relative to the receiver, the plate having formed therein an eccentric opening having a shape and size corresponding to the opening of the web, the outer wall defining the receiver recess and the locking plate outer edge being complementarily frusto-conical in contour, said locking plate being provided with means for facilitating rotation of the plate by the user comprising a pair of finger grips projecting from the plate and disposed symmetrically about the rotational axis.

* * * * *